US005241807A

United States Patent [19]

Quick et al.

[11] Patent Number: 5,241,807

[45] Date of Patent: Sep. 7, 1993

[54] METHOD AND APPARATUS FOR WRAPPING LOLLIPOPS AND SIMILAR ARTICLES

[76] Inventors: Howard E. Quick, 109 Dewey; Roger L. Quick, 310 Moccasin; Carl G. Quick, 643 Circle Ridge Dr.; Robert A. Quick, 407 Moccasin, all of Buchanan, Mich. 49107; Grover E. Hendricks, 1806 Cass St., Niles, Mich. 49120

[21] Appl. No.: 841,709

[22] Filed: Feb. 26, 1992

[51] Int. Cl.[5] ..... B65B 11/00

[52] U.S. Cl. ..... 53/594; 53/370; 53/371.3; 198/377; 414/157

[58] Field of Search ..... 198/377; 414/150, 157, 414/158; 426/134; 53/134.1, 209, 217, 557, 594, 370, 370.8, 371.3, 483

[56] References Cited

U.S. PATENT DOCUMENTS

| | | | |
|---|---|---|---|
| 472,202 | 4/1892 | Tripp . | |
| 516,136 | 3/1894 | Tripp . | |
| 1,022,761 | 4/1912 | Stvanek . | |
| 1,126,719 | 2/1915 | Dearborn . | |
| 1,200,365 | 10/1916 | Kempf . | |
| 1,239,597 | 9/1917 | Heck . | |
| 1,530,171 | 3/1925 | Haas . | |
| 1,807,981 | 6/1931 | Haas . | |
| 1,978,611 | 10/1934 | Styles . | |
| 2,001,074 | 5/1935 | Stout et al. . | |
| 2,185,593 | 1/1940 | Kaeding et al. . | |
| 2,246,243 | 6/1941 | Clark . | |
| 2,257,463 | 9/1941 | Goodwyn . | |
| 2,278,005 | 3/1942 | Van Veen . | |
| 2,322,430 | 6/1943 | Fay . | |
| 2,447,569 | 8/1948 | Eisler . | |
| 2,547,836 | 4/1951 | Pfeiffer . | |
| 2,684,839 | 7/1954 | Rice . | |
| 2,705,857 | 4/1955 | Fox et al. . | |
| 2,830,462 | 4/1958 | Vettese | 414/157 X |
| 2,872,768 | 2/1959 | Shepler . | |
| 3,076,644 | 2/1963 | Friedland et al. . | |
| 3,264,115 | 8/1966 | Davis . | |
| 3,272,152 | 9/1966 | Williams . | |
| 3,285,199 | 11/1966 | Waite et al. . | |
| 3,356,110 | 12/1967 | Tuit . | |
| 3,747,737 | 7/1973 | Brooke | 198/377 |
| 3,851,440 | 12/1974 | Horsky . | |
| 4,014,156 | 3/1977 | Klahn et al. . | |
| 4,159,612 | 7/1979 | Johnson et al. | 53/594 |

FOREIGN PATENT DOCUMENTS

| | | | |
|---|---|---|---|
| 36282 | 9/1981 | European Pat. Off. | 53/594 |
| 64575 | 11/1982 | European Pat. Off. | 53/594 |
| 328145 | 4/1930 | United Kingdom | 53/594 |

*Primary Examiner*—John Sipos
*Assistant Examiner*—Daniel Moon
*Attorney, Agent, or Firm*—Barnes & Thornburg

[57] ABSTRACT

A method and apparatus for wrapping lollipops wherein the candy portion is first placed in a preformed wrapper envelope and then loaded between chuck jaws translated on a conveyor. The conveyor includes a plurality of chucks, and the chuck jaws of each chuck grip the candy portion of a single lollipop and move the lollipop along a linearly extending heat sealing station wherein the chuck is rotated to cause the wrapper to twist about the stick of the lollipop The chuck then moves the lollipop to an ejection and counting station where the chuck jaws are automatically opened. After the lollipop leaves the chuck, the chuck jaws are realigned and the chuck is returned to the loading station with the chuck jaws open to receive another lollipop. Movement of the chuck jaws is controlled at each station by underlying cams. As the conveyor carries the chuck over the cams the chuck jaws are opened, closed and/or rotated. During twisting of the wrapper about the stick and heat sealing, a stick support conveyor intersects with the chuck conveyor to maintain the stick in a preselected orientation. The chuck conveyor and the stick support conveyor are mechanically connected to travel at the same speed and can be driven by a single motive source.

3 Claims, 9 Drawing Sheets

METHOD AND APPARATUS FOR WRAPPING LOLLIPOPS AND SIMILAR ARTICLES

BACKGROUND AND SUMMARY OF THE INVENTION

The present invention relates generally to methods and apparatus for wrapping articles More particularly, this invention relates to automated wrapping of lollipops.

A "lollipop" may be generally defined as a piece of candy or confection attached to the end of a stick. Lollipops are sold in a variety of flavors, generally distinguished by color, and in a variety of shapes, generally intended to be aesthetically appealing. The stick portion of the lollipop is generally formed from tightly rolled paper.

Lollipops are generally wrapped in a transparent material, such as cellophane, to permit purchasers to select lollipops according to flavor and/or shape. Such transparent wrappings also permit detection of defects, such as chips or cracks, in the lollipop. Being an edible item, it is also desirable for lollipops to be wrapped in a manner which keeps the candy fresh, clean and free from dirt and contaminants. Further, as with many other foods, there is emphasis today on wrapping lollipops in a manner which discourages or provides indicia of tampering or adulteration of the food. Once properly wrapped, it is important that the integrity of the wrapping be maintained during shipping and display.

Prior techniques for wrapping lollipops included several common features whether the wrapping was done by hand or with automated machinery. One method was to place the candy portion in the center of a piece of material and then fold the material over the candy and twist it about the stick Another method was to place the candy portion in a pre-formed envelope and gather the open side of the envelope together and twist it about the stick. Both of these techniques had the advantages of allowing the wrapper to conform to the shape of the candy and leaving the end of the stick free to facilitate display of the lollipop. Unfortunately, merely twisting the wrapper about the stick did not prevent the wrapper from untwisting during shipping, and the lollipop could be tampered with by untwisting and then retwisting the wrapper without leaving any visible indicia of wrapper removal. Further, prior wrappings were not always tight enough about the stem to isolate the candy from the air and, thus, freshness was lost because of small gaps between the wrapper and the stick.

It has also been suggested to completely encapsulate the candy and the stick in a wrapper to ensure freshness and prevent tampering. However, that technique requires additional quantity of wrapping material and often precludes use of the stick to support the candy on display and conformity of the wrapper to the candy shape. Thus, the overall product cost is increased and accessibility and product attractiveness can be reduced.

Some prior wrapping methods have placed the candy portion between the two pieces of wrapping material, with the stick extending outwardly from the wrapping material, and have then bonded those two pieces together at their edges by adhesive or heating. However, to avoid adhering of the adhesive to the stick or burning of the stick in the heat bonding process, a small gap is often left about the stick where it crosses the edges of the wrapping material. Thus, this method does not produce an air-tight wrapper, and product freshness can be detrimentally effected In hand wrapping lollipops it has previously been suggested to place the candy in a pre-formed envelope, twist the open side of the envelope about the stick, and then turn that twisted portion of the envelope against a heat source to partially melt the envelope material into an air-tight seal against the stick. Such a heat sealed wrapper had the advantages of tamper resistance, greater preservation of freshness, and a longer lasting bond. However, care was required to avoid burning the stick or melting through the wrapper by prolonged or uneven contact with the heat source. Also, wrapping lollipops in this manner by hand is a relatively slow process which could provide inconsistent results.

Prior automated lollipop wrapping machinery was often cumbersome and subject to relatively frequent breakdown or misalignment due to the multiple functions and manipulations in each step or station of the wrapping process. Further, often a change in the shape of the lollipop to be wrapped would require extensive modification and downtime of the machinery, especially where the machinery must grip the candy portion of the lollipop. To help avoid or minimize the need such modifications prior lollipop wrapping machinery would engage the stick rather than the candy portion when moving the lollipop between wrapping stations. However, since the stick has a smaller surface area for engagement and is further from the center of gravity of the lollipop, greater care must often be taken in loading of the lollipops and/or more complicated candy support structures employed. Moreover, regardless of which portion of the lollipop is engaged by the machinery, relative motion between the lollipop and the wrapper after the wrapper is in place, as can result from normal transport through the machinery, can degrade the integrity of the seal.

Thus, it is an object of the present invention to provide an improved method and apparatus for wrapping lollipops. Other objects of the present invention, individually and collectively, include the provision of:

1. an inexpensive method and apparatus for wrapping candy,
2. secure and tamper resistant wrappers for lollipops,
3. a lollipop wrapper which maintains a tight seal about the candy portion until intentionally unwrapped by the consumer,
4. a lollipop wrapping apparatus which readily accepts lollipops of different shapes,
5. an apparatus for automatically wrapping candy with greater operational reliability,
6. an apparatus for automatically wrapping candy which is easier to load with candy,
7. an apparatus for quickly applying a heat sealed wrapper of clear plastic material to an edible article, and
8. an apparatus for automatically wrapping and counting lollipops at various different speeds of operation.

These and other objects of the present invention are attained by the provision of a method and apparatus for wrapping lollipops wherein the candy portion is first placed in a pre-formed wrapper envelope and then loaded between chuck jaws translated on a conveyor. The conveyor includes a plurality of chucks, and the chuck jaws of each chuck grip the candy portion of a single lollipop and move the lollipop along a linearly extending heat sealing station wherein the chuck is rotated to cause the wrapper to twist about the stick of the lollipop. The chuck then moves the lollipop to an ejection and counting station where the chuck jaws are automatically opened. After the lollipop leaves the chuck, the chuck jaws are realigned and the chuck is returned to the loading station with the chuck jaws open to receive another lollipop. Movement of the chuck jaws is controlled at each station by underlying cams. As the conveyor carries the chuck over the cams the chuck jaws are opened, closed and/or rotated. During twisting of the wrapper about the stick and heat sealing, a stick support conveyor intersects with the chuck conveyor to maintain the stick in a preselected orientation. The chuck conveyor and the stick support conveyor are mechanically connected to travel at the same speed and can be driven by a single motive source.

Other objects, advantages and novel features of the present invention will become readily apparent to those of ordinary skill in the art upon consideration also of the following drawings and detailed description of preferred embodiments.

DETAILED DESCRIPTION OF THE PREFERRED EMBODIMENTS

As an overview, the method and apparatus of the present invention closes and seals an envelope wrapper about an article of food, such as a lollipop. Preferably, the envelope wrapper is preformed and the candy portion of the lollipop is placed therein with the free end of the lollipop stick protruding from the envelope wrapper. Prior to closing the envelope wrapper about the lollipop, it is loaded into the apparatus embodying the present invention either by an automatic loading apparatus or by hand loading.

The apparatus of the present invention includes, for example, a chuck conveyor portion and a stick support conveyor portion which are mechanically interconnected by drive gears to move at the same speed. This mechanical interconnection permits a single electric motor to drive both conveyors. The chuck conveyor portion includes a plurality of chucks, each of which engage a single lollipop at a time. The stick support conveyor portion includes a plurality of guide means each of which are associated in operation with a single chuck to maintain pre-selected stick alignment and orientation with respect to the chuck and the heating blocks used to heat seal the wrapper to the stick.

The chucks include, for example, a pair of hinged jaws to grip the envelope wrapper at the candy portion. The jaws are movable between open and closed positions by leveraging force applied from a vertically moveable rod within the chuck. Vertical motion of this rod is caused by engagement with underlying cam surfaces the chuck is moved over by the conveyor. A linear, horizontal cam positioned off of the rotational axis causes the chuck jaws to rotate when the stick is positioned adjacent the heating blocks In this manner the envelope wrapper is simultaneously twisted and heat sealed about the stick.

As the chuck conveyor comes to one end thereof it rotates downwardly. At this point the chuck jaws open to free the now wrapped and sealed lollipop. When the lollipop falls free of the chuck to be received in a storage or shipping container it moves past an optical counter.

Figure 1:
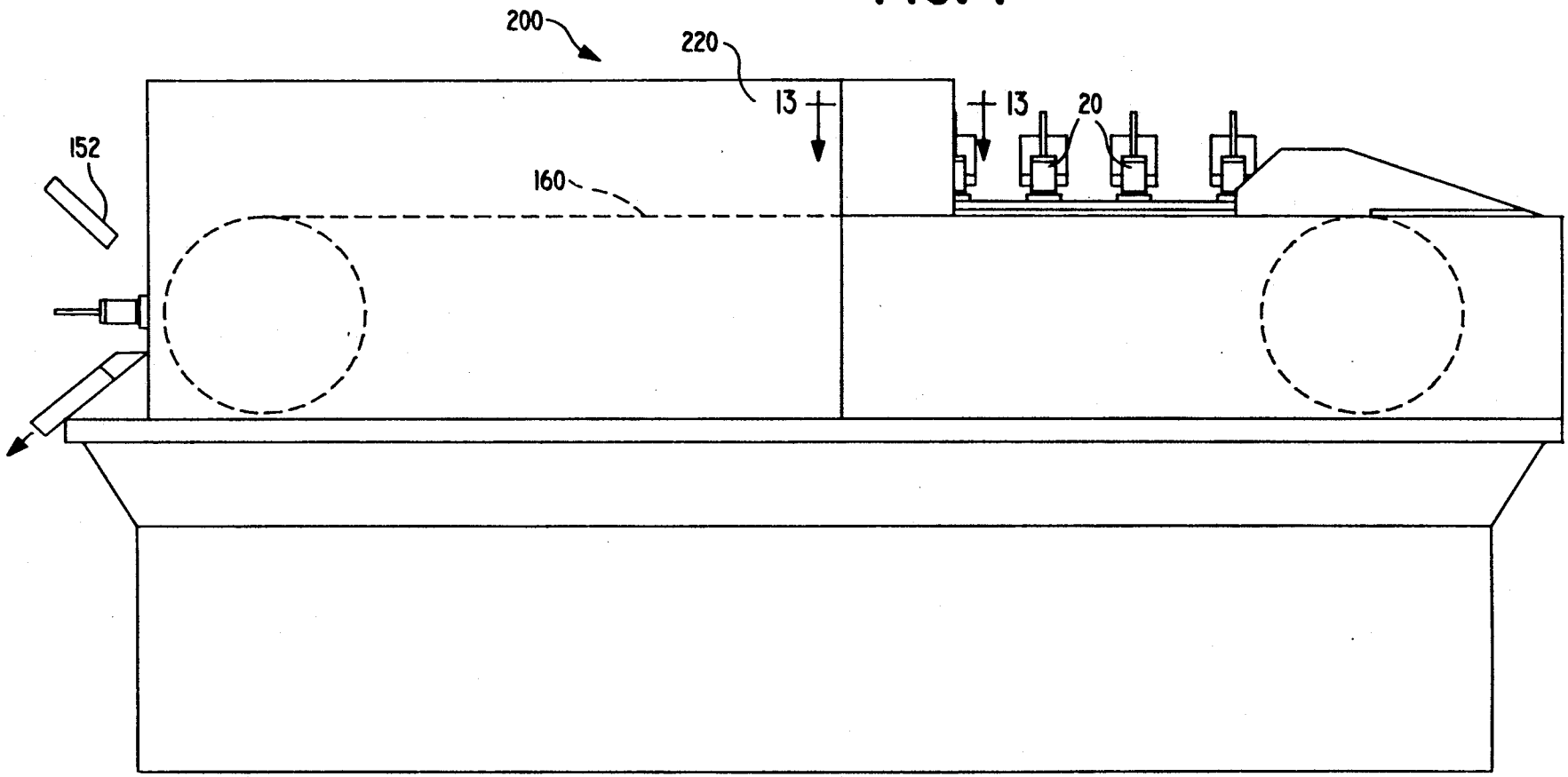
FIG. 1 is a left side elevational view of a preferred embodiment of an apparatus for wrapping lollipops and similar articles in accordance with the present invention.
Figure 2:
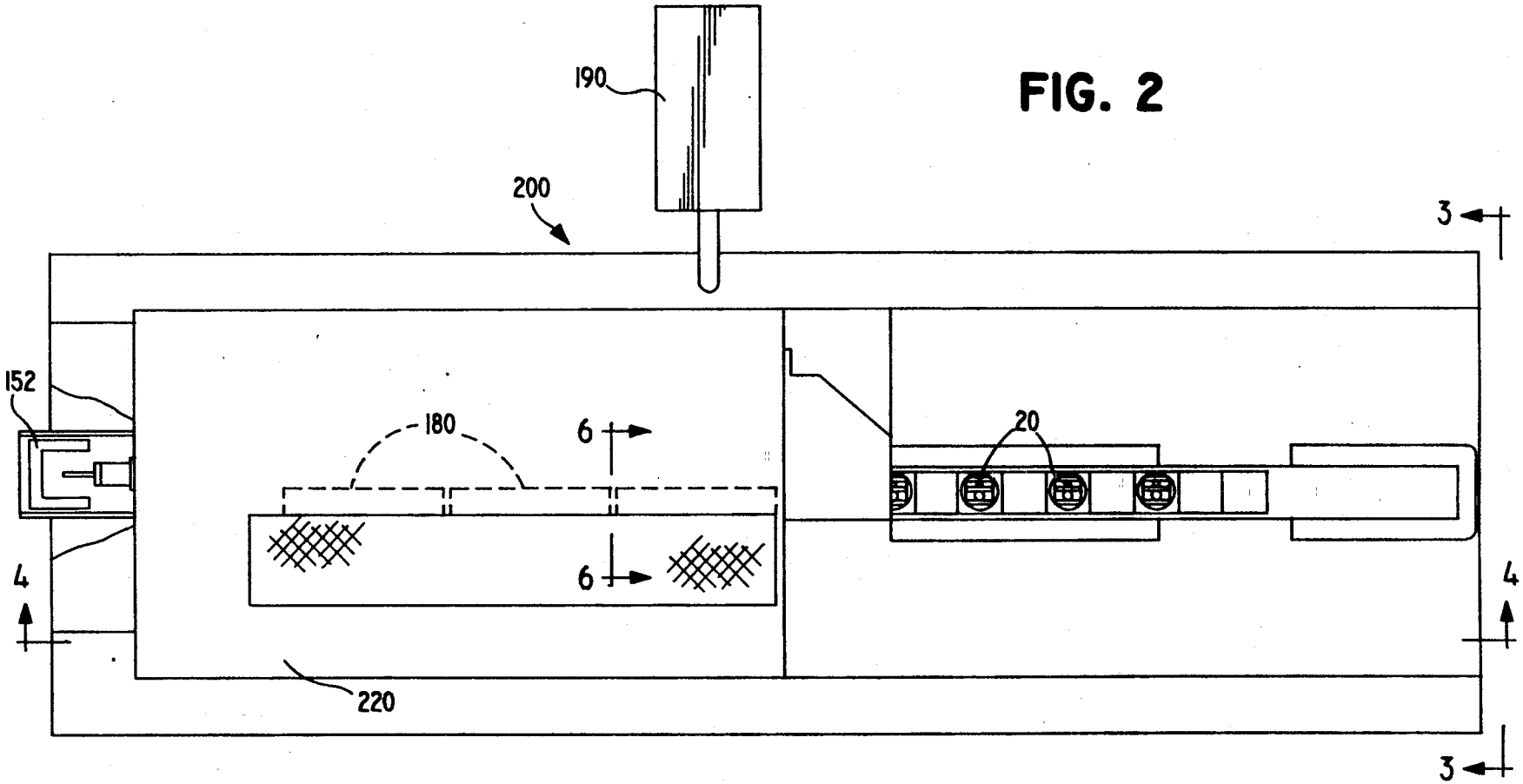
FIG. 2 is a top plan view of the apparatus for wrapping lollipops and similar articles shown in FIG. 1, with lollipops and wrappers removed.
Figure 3:
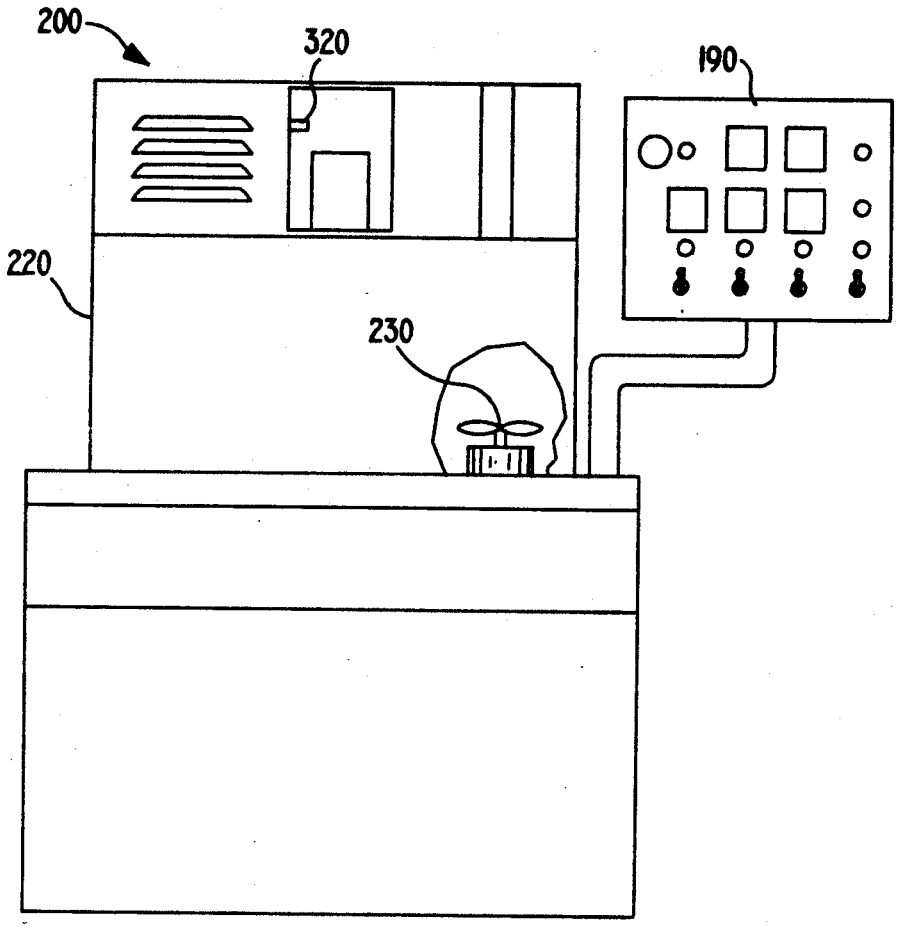
FIG. 3 is front end view of the apparatus for wrapping lollipops and similar articles shown in FIG. 1, as seen along line 3—3 in FIG. 2, with lollipops and wrappers removed.
Figure 4:
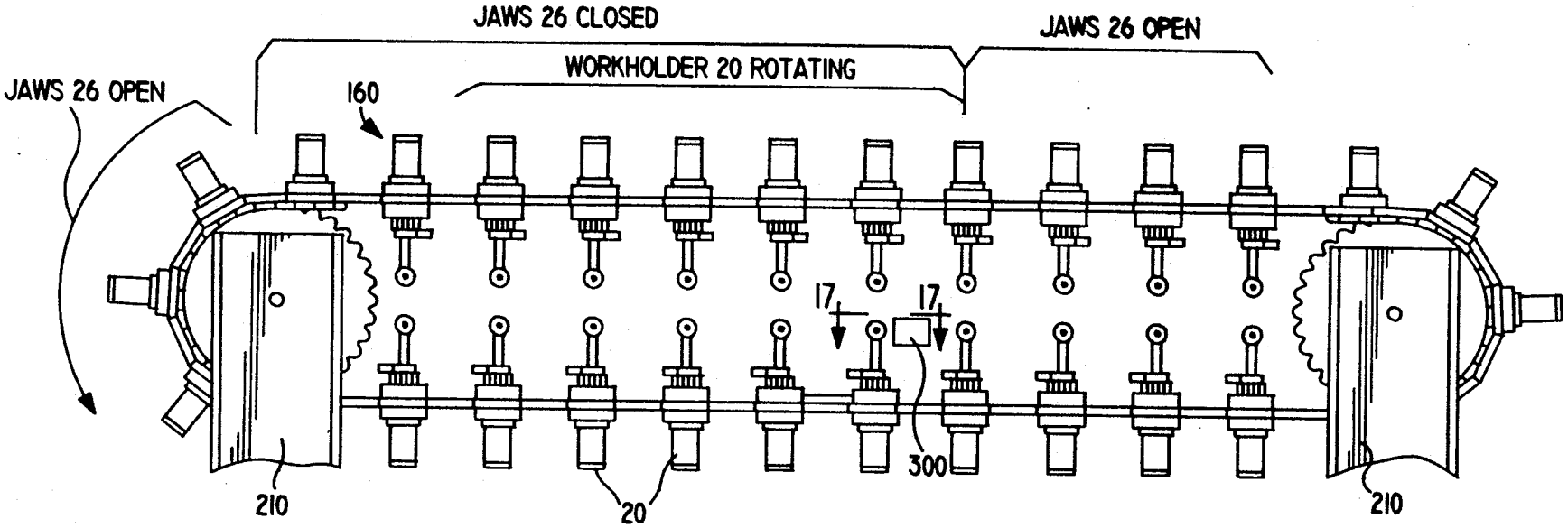
FIG. 4 is a partial sectional view of the apparatus for wrapping lollipops and similar articles shown in FIG. 1 taken substantially along line 4—4 of FIG. 2, showing the general arrangement of the first conveyor assembly with the external casing and lollipops removed.
Figure 5:
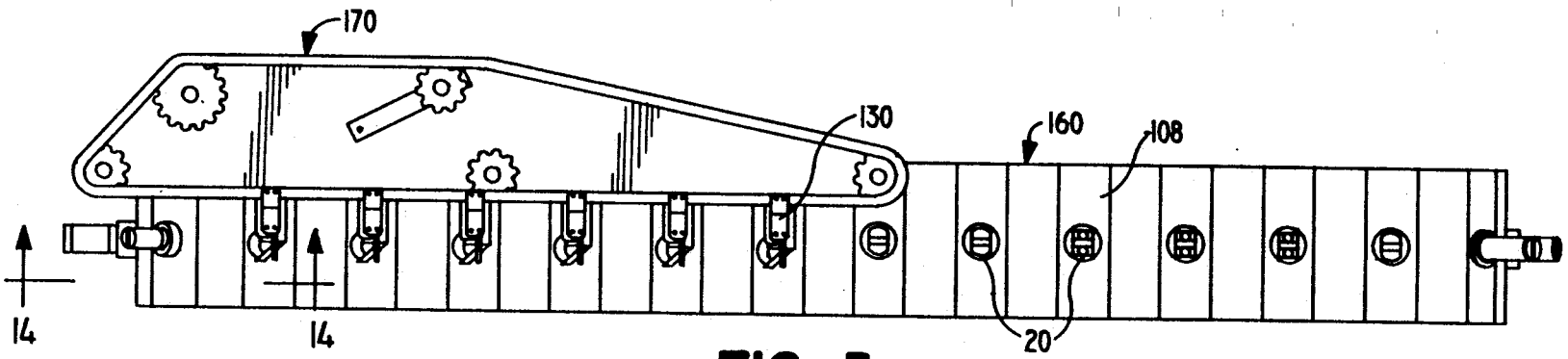
FIG. 5 is a top partial sectional view of the apparatus for wrapping lollipops and similar articles shown in correspondence to FIG. 4 and except for inclusion of the second conveyor assembly showing the general relationship of the second conveyor assembly to the first conveyor assembly with several of the guide means, heating blocks and lollipops removed.

Referring now to the drawings, in which like-referenced characters indicate corresponding elements throughout the several views, attention is first directed to FIGS. 1, 2 and 5 which generally illustrate a preferred embodiment of the apparatus for wrapping lollipops and similar articles according to the present invention. This apparatus is indicated generally as element 200. Wrapping apparatus 200 includes a plurality of workholders or chucks 20 located on first conveyor 160, a plurality of guide means 130 located on second conveyor 170, and one or more heating blocks 180. First conveyor 160 and second conveyor 170 are both preferably endless chain-type conveyors mounted on drive wheels which provide workholder 20 and guide means 130 with continuous circuitous motion. First conveyor 160 and second conveyor 170 intersect and extend along a common line during a portion of their paths, allowing workholder 20 and guide means 130 to travel parallel to one another along this line. The various components are all housed by frame 210, which can be partially enclosed by sheet metal casing 220.

Figure 15:
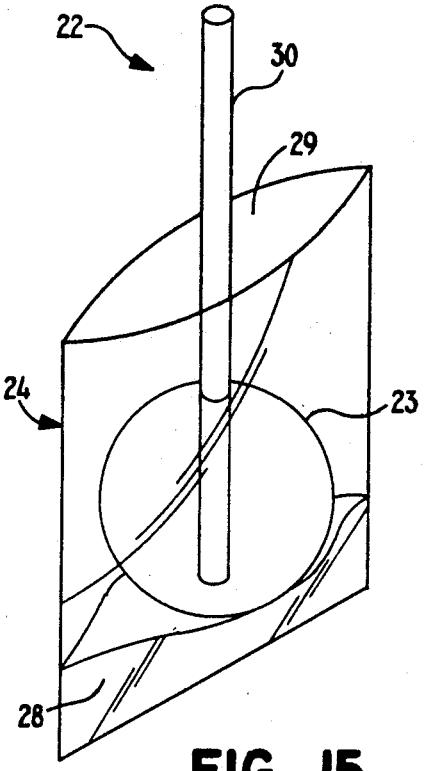
FIG. 15 is a perspective view showing a lollipop inserted into a wrapper prior to being twisted and sealed by the apparatus for wrapping lollipops and similar articles shown in FIG. 1.
Figure 16:
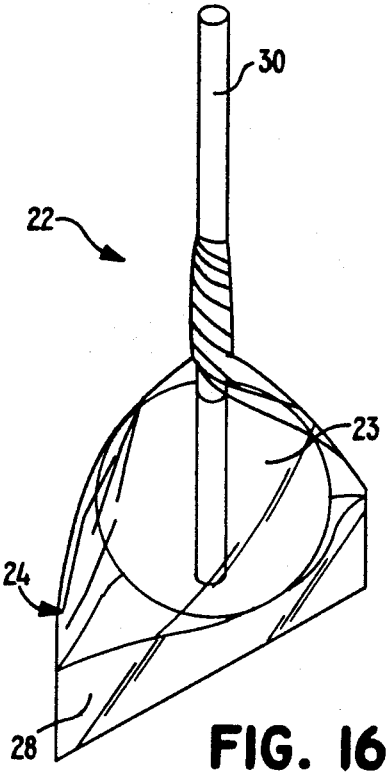
FIG. 16 is a perspective view of the lollipop and wrapper after being twisted and sealed by the apparatus for wrapping lollipops and similar articles shown in FIG. 1

It is contemplated that wrapping apparatus 200 be used to wrap, for example, lollipops 22 having candy portion 23 and stick 30, as shown in FIGS. 15 and 16. In the preferred embodiment shown, candy portion 23 of lollipop 22 is of a generally spherical shape. However, other shapes, regular or irregular, may be wrapped using the present invention by modification of the chuck jaw cavity shape as discussed below. Lollipop stick 30 is typically a slender stem, affixed at one end to candy portion 23. It is preferred that stick 30 be made of paper or plastic, although other materials may also be used.

In order to keep candy portion 23 free of contaminants it is beneficial to provide candy portion 23 with an impervious and well-sealed wrapper 24. Various materials can be used to fabricate wrapper 24, such as paper, cellophane, barrier film plastic or the like. In the present preferred embodiment, it is preferred that cellophane or some other transparent material be used to fabricate wrapper 24. As wrapper 24 is preferably to be substantially formed to the shape of candy portion 23 and twisted about stick 30, it is also preferred that wrapper 24 be of a flexible nature. Currently, the most preferred wrapping material is a triple ply laminated cellophane produced by Olin Corp. and marketed as VP-123.

When wrapping lollipop 22 with wrapping apparatus 200, it is preferred that wrapper 24 be preformed in the shape of a rectangular envelope, including open end 29 and sealed top 28. Although candy portion 23 can be initially positioned in wrapper 24 by various methods, the currently preferred method is to manually insert candy portion 23 through open end 29 into wrapper 24. As so positioned, lollipop 22 and wrapper 24 are manually placed as a combination in workholder 20 of wrapping apparatus 200, and wrapper 24 is thereafter tightly sealed about candy portion 23 and lollipop stick 30 by the present invention.

Workholder 20 includes a pair of jaws 26 which hold lollipop 22 and wrapper 24 during the wrapping process. Jaws 26 are oppositely disposed, and are spaced apart to form chamber 34 therebetween. This is shown, for example, in FIG. 11. Each jaw 26 includes gripping surface 36, and recessed within gripping surface 36 is concave depression or cavity 38. Concave depression 38 on gripping surface 36 accepts and holds lollipop 22. In the preferred embodiment shown the shape of concave depression 38 is preferably semi-spherical because workholder 20 of the present invention is shown to be used with lollipops having a generally spherical shape. However, workholder 20 can be readily modified by substituting different jaws so that concave depression 38 can take on any desired shape to generally correspond to the shape of the article to be wrapped.

Figure 11:
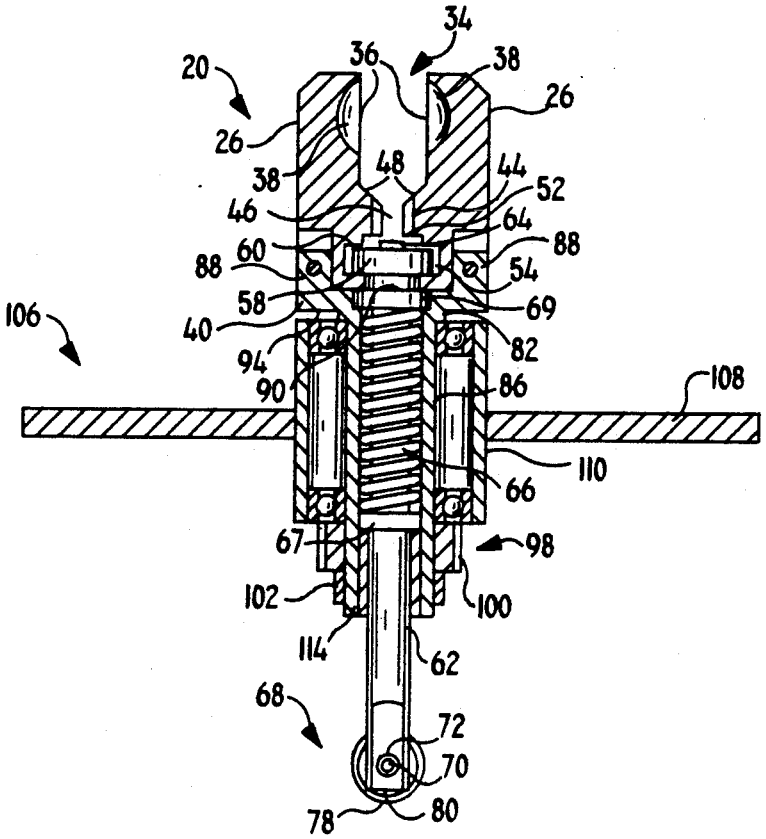
FIG. 11 is a cross-sectional side view of the workholder shown in FIG. 6 taken substantially along line 11—11 of FIG. 9.

Jaws 26 are pivotably mounted to collar 40 at hinge 42. Thus, jaws 26 are moveable between a closed position and open positions. Jaws 26 are normally biased by spring 66 to the closed position, as is shown in FIG. 11. However, due to the hinged connection jaws 26 may rotate about hinge 42 to open positions.

Adjacent gripping surface 36, each jaw 26 includes a step 44 which protrudes into chamber 34. Between opposing steps 44 is space 46. Top 28 of wrapper 24 is, for example, to be inserted into space 46 to provide alignment of lollipop 22 within chamber 34. Step 44 includes top surface 48, side surface 50 and bottom surface 52. Preferably, top surface 48 slopes downwardly from gripping surface 36 when workholder 20 is in an open position so as to increase the ease with which lollipop 22 may be properly placed between jaws 26. In this way top surface 48 acts as a guide for top 28 when lollipop 22 in inserted into workholder 20. When jaws 26 close, top 28 tends to move automatically into space 46.

Adjacent bottom surface 52 of step 44, each jaw 26 includes bearing receptacle 54. In the preferred embodiment shown, bearing receptacle 54 is a recess having a generally semi-circular cross-section. Bearing 58 is disposed within bearing receptacle 54 and governs the movement of jaws 26 between the open and closed position. Preferably, jaws 26 are normally biased to the closed position. In this position, bearing 58 exerts little or no force against jaws 26. However, when it is desired to open jaws 26, an upward force is exerted on bearing 58, which in turn pushes against top surface 60 of bearing receptacle 54. This upward force causes jaws 26 to pivot about hinge 42 to open positions.

Bearing 58 is attached to rod 62. In the preferred embodiment shown, bearing 58 is generally cylindrical in shape, and is attached to rod 62 near top end 64. Preferably, rod 62 is a relatively slender cylinder. Surrounding a portion of rod 62 is spring 66. Spring 66 rests normally in an untensioned, relaxed state. As can be seen in Figure spring 66 rests between shoulder 67 and ring 69. Ring 69 is slidably mounted to rod 62 and fixed to collar 40, such that upward movement of rod 62 compresses spring 66 between ring 69 and shoulder 67. When the upward force applied to rod 62 is of a magnitude that the spring force of spring 66 is overcome, bearing 58 is forced against top surface 60 of bearing receptacle 54.

Opposite top end 64, rod 62 includes bottom end 68. Bore 70 extends through rod 62 near bottom end 68. Pin 72 is positioned within bore 70. It is preferred that pin 72 be of a length greater than the diameter of rod 62 near bottom end 68 and extend radially beyond the surface of rod 62 at each end of pin 72. Rollers 76 are mounted on those extending ends of pin 72 so as to allow full rotation independent of pin 72 and each other. It is also preferred that the diameter of roller 76 be such that roller surface 78 extends below bottom surface 80 of rod 62. When it is desired to open jaws 26, rollers 76 are drawn past an upwardly inclined ramp which forces rollers 76 to roll "uphill" to a cam surface 124. At the same time, workholder 20 is restrained against upward movement by bearings 125 disposed along each side of the top of plate 108. Thus, the upward cam force is transmitted from roller 76 to pin 72 and rod 62.

Figure 7:
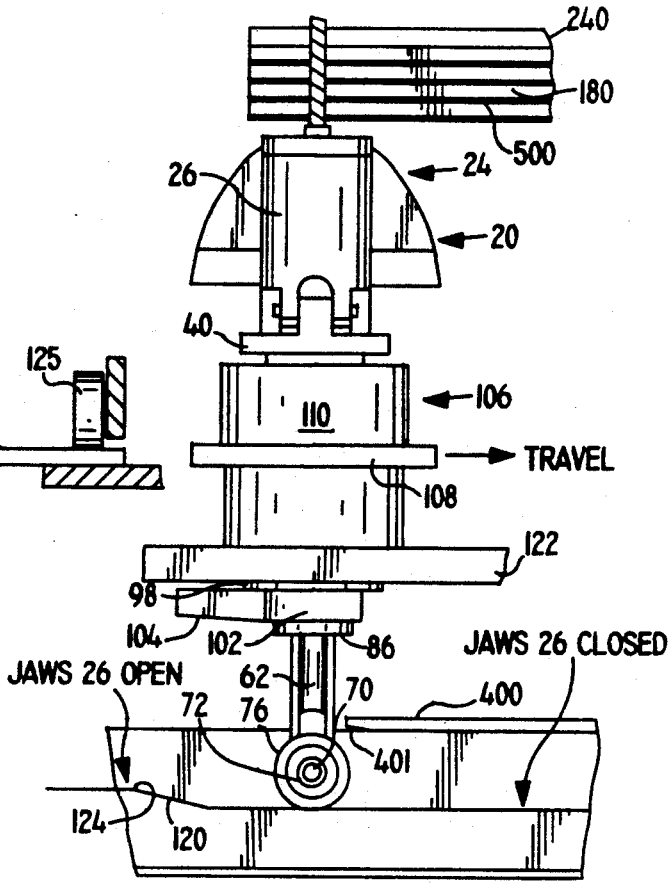
FIG. 7 is a right side view of the workholder shown in FIG. 6.

To close jaws 26, conveyor 160 moves workholders 20 to a different location where the upward force on rollers 76 is not present and the force of spring 66 forces rod 62 downward. This can be done by eliminating the contact of rollers 76 with cam surface 124 by rolling rollers 76 downward off a downwardly inclined ramp 120, as is shown in FIG. 7.

Housing 82 also includes collar 40 and sleeve 86. Collar 40 is, for example, a generally flat, circular member. Collar 40 includes two oppositely disposed platforms 88, extending from top surface 90 of collar 40. Jaw 26 is hingably attached to platform 88, and thus to housing 82.

Figure 10:
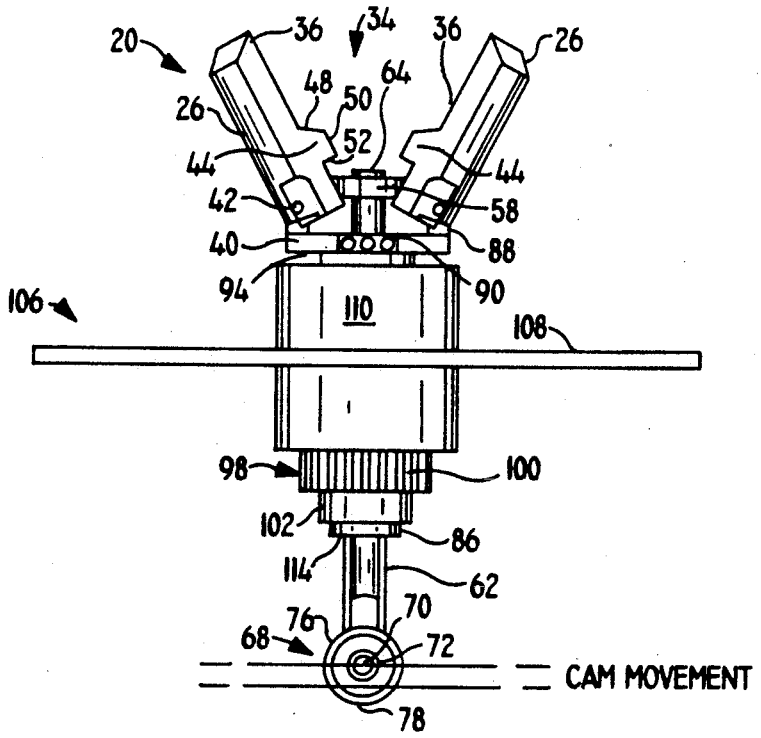
FIG. 10 is a side elevational view of the workholder shown in FIG. 6 with the workholder jaws in an opened position and with the lollipop removed therefrom.

Extending from bottom surface 94 of collar 40, opposite platform 88, is sleeve 86. This is shown in FIG. 10. Sleeve 86 is a hollow, generally cylindrical member. Sleeve 86 has an inner diameter dimensioned so as to be slightly larger than rod 62. Thus, sleeve 86 is able to encase a portion of rod 62, and rod 62 is allowed to move within sleeve 86 and collar 40. Rod 62 can rotate without exerting a rotative force on housing 82. Likewise, housing 82 can rotate without exerting a rotative force on rod 62.

Figure 6:
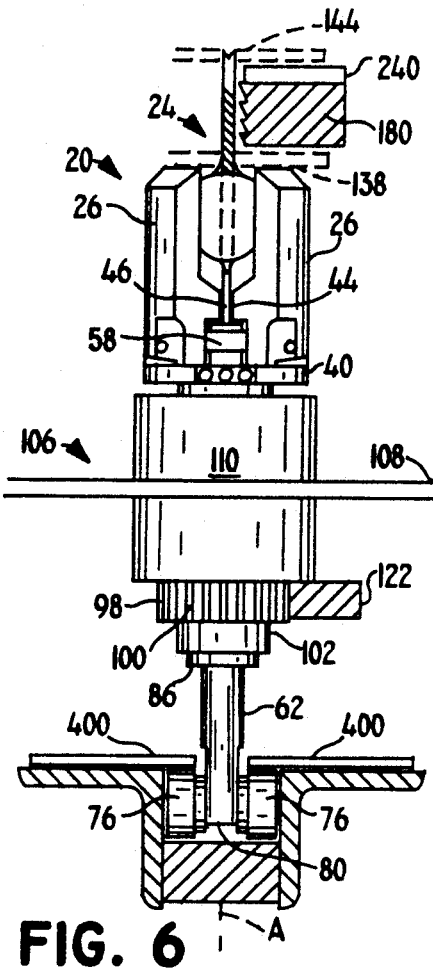
FIG. 6 is a front view of the workholder of the apparatus for wrapping lollipops and similar articles shown in FIG. 1 taken cross-sectionally substantially along line 6—6 of FIG. 2, showing the general arrangement of the workholder, with the guide means removed.
Figure 8:
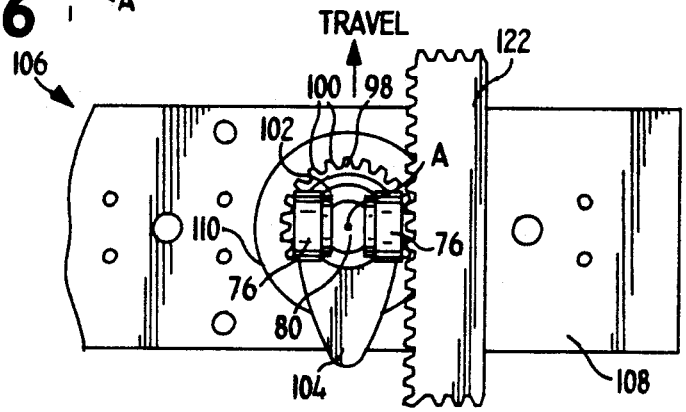
FIG. 8 is a bottom view of the workholder shown in FIG. 6.
Figure 9:
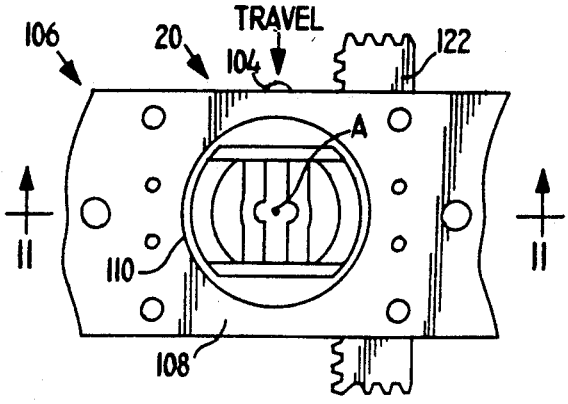
FIG. 9 is a partial top plan view of the workholder shown in FIG. 6 with the lollipop removed therefrom.

As shown in FIGS. 6 and 8, a gear 98 is located near bottom end 114 of housing 82. Gear 98 is generally circular in cross-section, and has a plurality of teeth 100 along its exterior periphery. Gear 98 is fixed to the exterior of housing 82. Wrapping apparatus 200 also includes fixed rack gear 122 which is matingly engageable with gear 98. When so engaged, gear 98 and housing 82 are rotated about axis A relative to wrapping apparatus 200 as conveyor 160 moves workholder 20 along rack gear 122.

Offset cam 102 is located adjacent gear 98, preferably near bottom end 114 of housing 82 and also located on the exterior of housing 82. Offset cam 102 is preferably of an irregular horizontal cross-section. In the preferred embodiment shown, offset cam 102 includes an irregularly shaped tab 104 extending therefrom. Offset cam 102 is utilized to govern the rotational alignment of housing 82.

Figure 17:
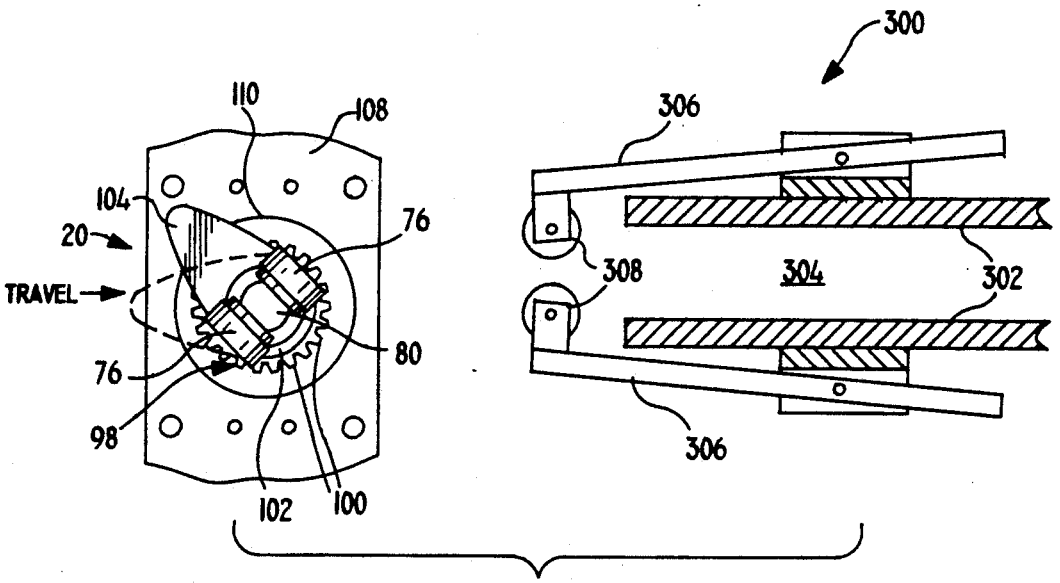
FIG. 17 is a partial bottom view of the apparatus for wrapping lollipops and similar articles shown in FIG. 1 taken substantially along line 17—17 of FIG. 4 and showing the offset cam aligning channel not present in FIG. 4.

For example, offset cam 102 is used to align jaws 26 before loading of lollipop 22 and wrapper 24. It is preferred that space 46 between steps 44 be aligned parallel to the line of motion of first conveyor 160 on which workholder 20 is attached. This allows a person loading wrapping apparatus 200 to more easily place lollipop 22 into workholder 20. Prior to insertion of the lollipop, workholder 20 is moved past aligning means 300. As can be seen in FIG. 17, aligning means 300 includes a pair of spaced ribs 302, defining channel 304 therebetween. Aligning means 300 also includes a pair of pivotable arms 306. Arms 306 include roller guides 308 attached thereto. Arms 306 are spring-biased such that guides 308 partially obscure entry of offset cam 102 into channel 304.

Channel 304 is dimensioned to receive offset cam 102 only when it is in certain orientations. For example, the width of channel 304 may be less than the largest diameter of offset cam 102, but greater than the smallest diameter of offset cam 102. In the preferred embodiments shown, offset cam 102 may pass through channel 304 only when tab 104 is pointing in a direction substantially parallel to the line of motion of first conveyor 160. As offset cam 102 initially contacts guides 308, guides 308 exert a force on tab 104, turning it and offset cam 102 until tab 104 is substantially parallel to the line of motion of first conveyor 160. As workholder 20 continues toward aligning means 300, arms 306 open, allowing offset cam 102 to pass through channel 304. Ribs 302 help maintain that desired orientation of tab 104.

As is seen in FIG. 6, workholder 20 also includes jacket 106. Jacket 106 comprises plate 108 and shell 110. Shell 110 is preferably a hollow, generally cylindrical member which encases a portion of housing 82 between collar 40 and gear 98. Housing 82 is rotatably mounted within shell 110 so as to allow full rotational motion of housing 82 with respect to plate 108. Plate 108 is fixed to first conveyor 160 and transports workholder 20 through the various workstations.

After lollipop 22 is placed into jaws 26, workholder 20 is conveyed off of cam surface 124 and down inclined ramp 120. This is best seen in FIG. 7. As rollers 76 come off of ramp 120, they are contacted by rail 400. Rail 400 exerts a downward force upon rollers 76 and thus upon rod 62. This positive locking action insures that jaws 26 fully close about lollipop 22. In the preferred embodiment shown, rail 400 includes an angled entry 401 which guides rollers 76 downward. Also, it is preferred that rail 400 extend parallel to the line of travel of workholder 20 for a length substantially equal to the length of rack gear 122. This tends to prevent jaws 26 from opening even slightly due to centrifugal forces during rotation of workholder 20.

Substantially simultaneous to contact with rail 400, guide member 130 swings into position over workholder 20 and about the protruding stick of lollipop 22. A plurality of guide members 130 are spaced about second conveyor 170 to correspond with the spacing of workholders 20 on first conveyor 160. The point where guide member 130 swings over workholder 20 begins a line of intersection of first conveyor 160 and second conveyor 170. Workholder 20 and guide means 130 share a common path of travel along this line. In the preferred embodiments shown, the plane of travel of second conveyor 170 is angled approximately 90° to the plane of travel first conveyor 160 to facilitate this interaction during operation.

Figure 12:
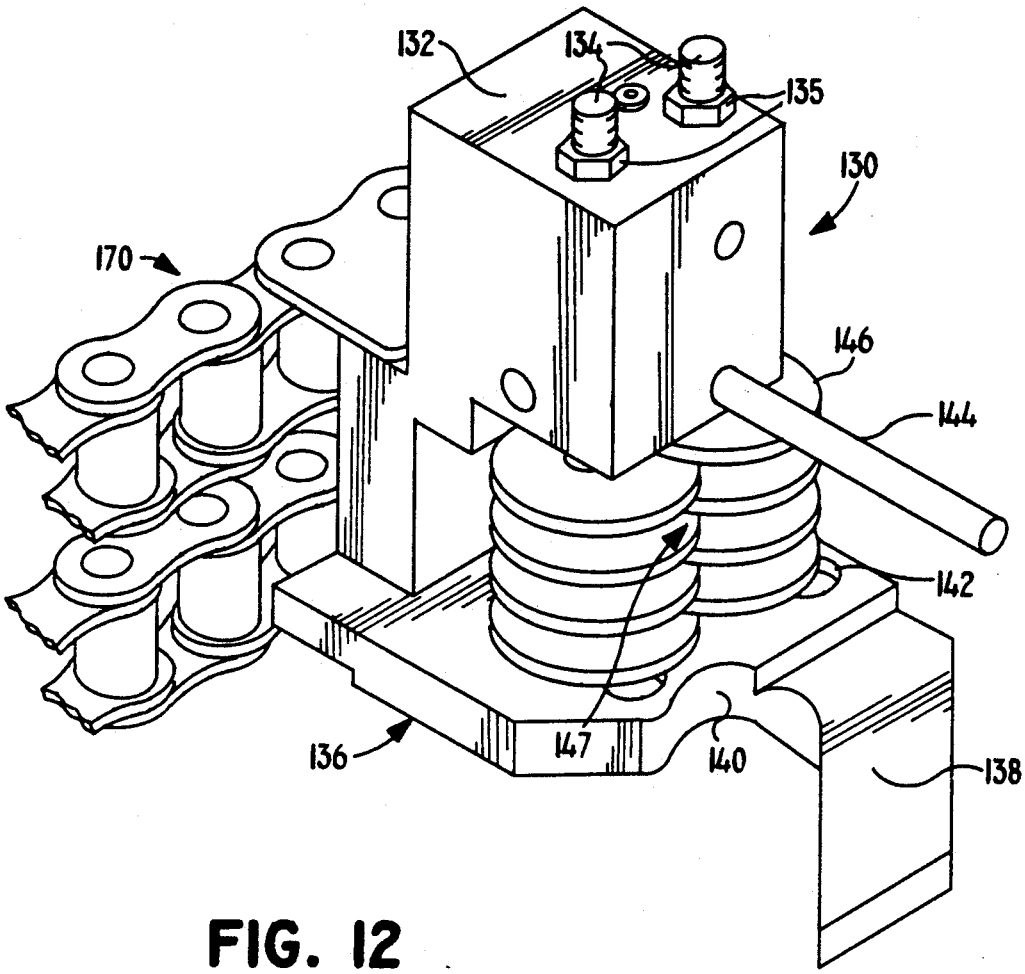
FIG. 12 is a perspective view of one of the guide members on the second conveyor assembly of the apparatus for wrapping lollipops and similar articles shown in FIG. 1.

As shown in FIG. 12, each guide member 130 generally includes base 132, and a pair of columns 134 which project through base 132 and are secured to base 132 by nuts 135. Connected to columns 134 opposite base 132 is finger support 136. Finger support 136 is a generally flat member which includes projecting finger 138 which extends out of finger support 136 at an angle or hook so as to create alcove 140. Finger support 136 also includes a plurality of holes 142 bored therein. These holes allow air to pass therethrough to cool finger support 136.

Guide member 130 also includes a cantilevered post 144, preferably formed as a generally slender cylinder which protrudes out of base 132 in generally the same radial direction as finger 138. Both finger 138 and post 144 serve to support and guide the stick of lollipop 22 as it is transported and rotated during the twisting and heat sealing of the wrapper to the stick.

Attached to columns 134 between base 132 and finger support 136 are a plurality of turning discs 146. These discs and columns 134 are preferably formed from a relatively hard material, such as Rockwell 70C scale steel. Discs 146 are mounted onto columns 134 so as to be fully rotational thereabout. Discs 146 are spaced apart on column 134, and are dimensioned such that a portion of generally vertical discs 146 on opposing columns 134 overlap. Thus, discs 146 form a groove 147 therebetween along this line of overlap. This groove 147 is vertically aligned with alcove 140. Post 144 is positioned behind and adjacent this vertical line.

As guide member 130 swings about lollipop 22, stick 30 is received by finger 138 near candy portion 23, and finger 138 guides stick 30 into alcove 140. Stick 30 thus rests in groove 147. This positioning of stick 30 maintains stick 30 in a substantially upright position. Post 144 contacts the protruding end portion of stick 30 opposite candy portion 23, and also serves to keep stick 30 upright.

Figure 13:
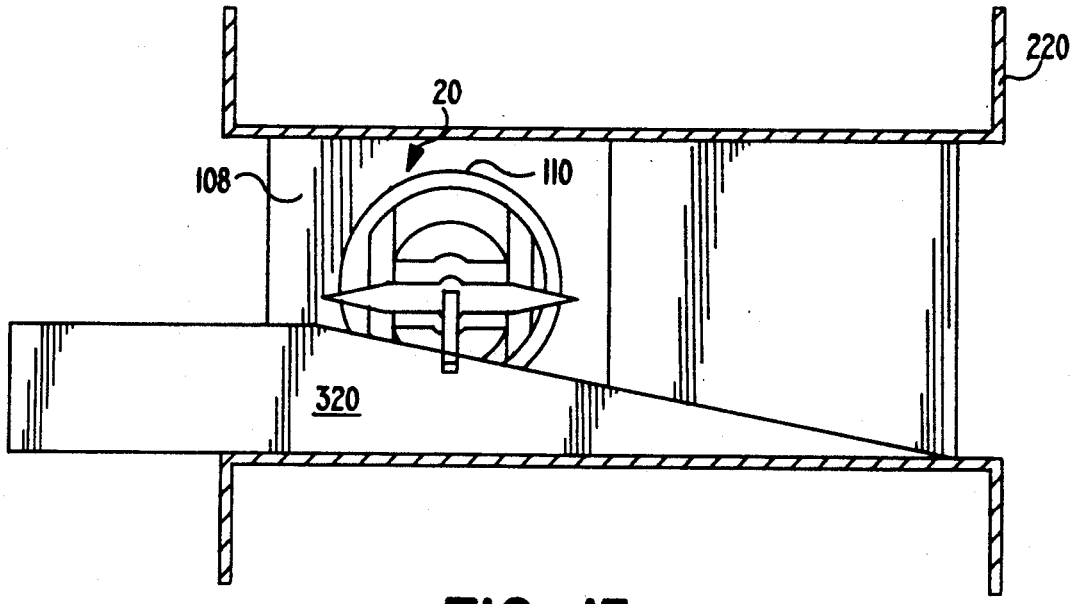
FIG. 13 is a partial cross-sectional top view of the apparatus for wrapping lollipops and similar articles shown in FIG. 1 taken substantially along lines 13—13 of FIG. 1.
Figure 14:
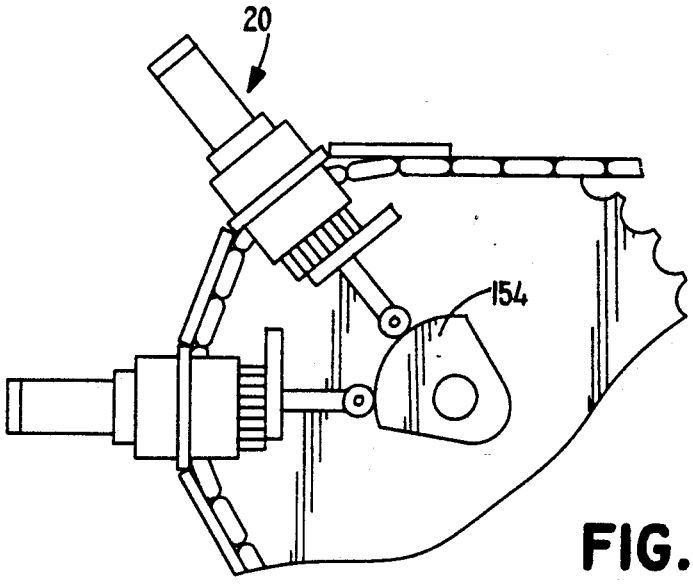
FIG. 14 is a partial side view of the apparatus for wrapping lollipops and similar articles shown in FIG. 1 taken substantially along line 14—14 of FIG. 5.

In the positioning of lollipop 22 for twisting and heat sealing of the wrapper to the stick, cornerpiece 320, shown in FIG. 13, is also employed. Cornerpiece 320 is attached to frame 210 and contacts stick 30 immediately after jaws 26 are closed about lollipop 22. Cornerpiece 320 aligns stick 30 to a substantially vertical position toward guide member 130. It has been found that lollipop 22 can be wrapped more effectively when stick 30 is in a substantially vertical position.

After workholder 20 moves down inclined ramp 120 and guide member 130 swings about stick 30, wrapper 24 is twisted and heated to provide a tight seal about stick 30. Gear 98 on housing 82 engages rack gear 122 located on frame 210. Since rack gear 122 is fixed to frame 210, this mating action causes housing 82 and thus lollipop 22 to rotate. This rotation causes open end 29 of wrapper 24 to twist about stick 30. During the twisting of wrapper 24 about stick 30, lollipop 20 travels past one or more heating blocks 180. In the preferred embodiment shown, wrapping apparatus 200 includes three heating blocks 180, aligned in series along the path of first conveyor 160.

Heating blocks 180 are preferably formed of steel to allow each block to reach and maintain high temperature levels. It is preferred that each heating block 180 be separately controlled, and thus each heating block may be maintained at a different temperature. While it is contemplated that in some instances, it may be beneficial to maintain heating blocks 180 at differing temperatures, the currently preferred method is to maintain all three heating blocks 180 at substantially the same temperature. It has been found that maintaining heating blocks 180 at approximately 395° F. produces a satisfactory result. The desired temperature depends on the nature and thickness of wrapper 24 and the speed of first conveyor 160. The temperature of 395° F. is preferred when using Olin VP-123 as the wrapping material and a workholder conveyor speed of approximately 16 feet per minute. It has also been found to be beneficial to have a horizontally grooved configuration or serrations 500 present on those surfaces of heating blocks 180 which contact wrapper 24 and stick 30. The currently preferred heating block is Fastheat model #2.500×1200W.

While experiencing continuous rotation, wrapper 24 and stick 30 pass adjacent heating blocks 180. Being subject to this heat, wrapper 24 experiences sufficient melting to form a tight bond about stick 30. Once the heat is removed, wrapper 24 is allowed to cool. Once cooled, wrapper 24 will tend to retain its tightly sealed shape about stick 30 until intentionally unwrapped by consumers.

After passing by heating blocks 180, gear 98 disengages rack gear 122 and lollipop 22 stops turning. Lollipop 22 is then released from workholder 20 and counted as it is moved toward a shipping or storage container. This is accomplished by allowing stick 30 to pass through light sensitive counting mechanism 152. If there is no stick 30 protruding from workholder 20, no count is registered. Accordingly, empty workholder 20 passing counting mechanism 152 will not trigger counting mechanism 152.

After or as lollipop 22 is counted, workholder 20 encounters cam surface 154. As rollers 76 contact cam surface 154, an upward force is applied to rod 62 which overcomes the biasing force of spring 66, and bearing 58 forces jaws 26 open. Lollipop 22 can then be easily removed or fall freely from workholder 20. In the preferred embodiment shown, workholder 20 is tilted downward before guide member 130 swings away from workholder 20 and jaws 26 open so that lollipop 22 will drop under influence of gravity from jaws 26. A receptacle (not shown) can be used to catch the wrapped lollipops as they are released from workholder 20.

After lollipop 22 is released from jaws 26, workholder 20 continues on its circuitous path. Workholder 20 disengages from cam surface 154, and jaws 26 return to the closed position. Workholder 20 then continues back toward the initial loading work station. However, before workholder 20 is ready to receive another lollipop 22, it is preferred that jaws 26 be aligned so that space 46 is positioned substantially parallel to the direction of travel first conveyor 160. This eases the placement of lollipop 22 and wrapper 24 within chamber 34. To align jaws 26, offset cam 102 is directed through aligning means 300. If tab 104 on offset cam 102 is out of line, it will contact guides 308, causing cam 102 and housing 82 to rotate. Cam 102 will rotate until it will fit within channel 304. Once in this orientation, jaws 26 are properly positioned to receive lollipop 22. Once jaws 26 are properly aligned, workholder 20 is directed onto another cam surface, again opening jaws 26, and allowing workholder 20 to receive another lollipop to be wrapped.

Wrapping apparatus 200 of the present invention includes other various components which are beneficial to the wrapping process. It is preferred that wrapping apparatus 200 include fan 230, provided within frame 210. Continued use of wrapping apparatus 200 may generate an undesirable amount of heat, particularly when heating blocks 180 are maintained at high temperatures. Fan 230 provides a continuous flow of positive air throughout wrapping apparatus 200, which cools the various components and reduces wear. To reduce the escape of heat to the atmosphere and as a safety precaution to users and other individuals in the vicinity of wrapping apparatus 200, heating blocks 180 are preferably at least partially surrounded by insulating cover 240. In the preferred embodiment shown, heating blocks 180 are insulated using a non-resin, non-asbestos cover. The preferred insulating material is manufactured by Albany International and is sold under the name Pyropel MD-12. One-eighth inch of this material has been found to be sufficient to insulate against excessive heat loss and provide a reasonable safety barrier.

The present invention also contemplates the use of control panel 190 to automatically monitor the entire process. The temperature levels of each heating block 180 may be set and controlled from control panel 190. Control panel 190 may also be used to register the number of sticks 30 which pass through counting mechanism 152. The entire wrapping apparatus 200, including first conveyor 160 and second conveyor 170 may also be controlled from control panel 190. Fan 230 and other features may be also controlled from control panel 190, allowing a user to oversee the entire operation from a single work station.

Further, first and second conveyors 160 and 170 are preferably endless chain-type conveyors and can be synchronistically driven by common gearing off of an electric motor. If for example, that electric motor is capable of variable speed control (as is preferred), the apparatus of the present invention can be readily adjusted to accept different loading rates and thereby provide different wrapping rates.

From the preceding description of the preferred embodiment, it is evident that the objects of the invention are attained by the present invention. Although this invention has been described and illustrated in detail, it is to be clearly understood that the same is by way of illustration and example only and is not to be taken by way of limitation. Therefore, the spirit and scope of this invention are to be limited only by the terms of the appended claims.

What is claimed:

1. An apparatus for wrapping lollipops having a candy portion and a stick comprising:

a first conveyor, workholder means, connected to said first conveyor, for receiving lollipops disposed in wrapper envelopes, said workholder means including gripping means for securing the candy portions of lollipops within the workholder means, at least one heating element mounted adjacent said first conveyor, said first conveyor including means for moving said workholder means past said heating element, rotation means, associated with said workholder means, for rotating said lollipop as said workholder means moves past said heating element such that a portion of said wrapper envelopes is heat sealed about the sticks of said lollipops, and a second conveyor is mounted adjacent said first conveyor and said second conveyor includes means for orienting said sticks and engaging said portion of sad wrapper envelopes to said sticks during rotation of said lollipop to twist said portion of said wrapper envelopes about said sticks.

2. The apparatus according to claim 1 wherein a counting means is disposed adjacent said first conveyor for determining the number of lollipops being wrapped.

3. An apparatus for wrapping lollipops having a candy portion and a stick, comprising:

a first conveyor;

workholder means, connected to said first conveyor, for receiving lollipops disposed in wrapper envelopes;

said workholder means including gripping means for securing the candy portion of said lollipops within the workholder means;

at least one heating element mounted adjacent said first conveyor;

said first conveyor including means for moving said workholder means past said heating element;

rotation means associated with said workholder means for rotating said lollipops as said workholder means moves past said heating element such that a portion of said wrapper envelopes is heat-sealed about said sticks of said lollipops; and a second conveyor, adjacent said first conveyor, including means for maintaining a predetermined orientation of said lollipops and engaging said portions of said wrapper envelopes to said sticks while being rotated and conveyed through said apparatus to twist said portion of said wrapper envelopes about sad sticks.

* * * * *